US008135314B2

(12) United States Patent
Miyoshi et al.

(10) Patent No.: US 8,135,314 B2
(45) Date of Patent: Mar. 13, 2012

(54) DEVELOPING DEVICE, PROCESS CARTRIDGE, AND IMAGE FORMING APPARATUS, METHOD OF DEVELOPING LATENT IMAGE

(75) Inventors: Yasuo Miyoshi, Kanagawa (JP); Hisashi Kikuchi, Kanagawa (JP); Norio Kudo, Kanagawa (JP); Nobuo Iwata, Kanagawa (JP); Tsukuru Kai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/342,935

(22) Filed: Dec. 23, 2008

(65) Prior Publication Data

US 2009/0169264 A1 Jul. 2, 2009

(30) Foreign Application Priority Data

Dec. 26, 2007 (JP) ..... 2007-334399
Sep. 22, 2008 (JP) ..... 2008-242079

(51) Int. Cl.
*G03G 15/09* (2006.01)

(52) U.S. Cl. ..... 399/267; 399/277

(58) Field of Classification Search ..... 399/254, 399/267, 274, 277
See application file for complete search history.

(56) References Cited

U.S. PATENT DOCUMENTS 7,356,288 B2 4/2008 Iwata et al.
2003/0086728 A1* 5/2003 Kikuchi ..... 399/272
2006/0210903 A1* 9/2006 Ohki et al. ..... 430/109.4
2007/0166079 A1 7/2007 Ichikawa et al.
2007/0264053 A1 11/2007 Iwata et al.
2007/0274740 A1 11/2007 Katoh et al.
2008/0038019 A1 2/2008 Kasahara et al.
2008/0056747 A1 3/2008 Miyoshi
2008/0145107 A1 6/2008 Miyoshi
2008/0240793 A1* 10/2008 Kobayashi et al. ..... 399/267
2008/0247786 A1* 10/2008 Nakayama et al. ..... 399/274
2008/0298845 A1 12/2008 Ohmura et al.
2008/0298866 A1 12/2008 Matsumoto et al.

FOREIGN PATENT DOCUMENTS

JP 5-82944 4/1993
JP 10-31363 2/1998
JP 11-184249 7/1999

(Continued)

OTHER PUBLICATIONS

Machine translation of 11-194617.*

*Primary Examiner* — David Gray
*Assistant Examiner* — Barnabas Fekete
(74) *Attorney, Agent, or Firm* — Oblon, Spivak, McClelland, Maier & Neustadt, L.L.P.

(57) ABSTRACT

A developing device includes a first screw that supplies a developer to a developing roller while agitating/conveying the developer in a first direction, and a screw that collects residual developer from the developing roller, agitates/conveys the residual developer in a second direction opposite to the first direction, and delivers the residual developer to the first screw. Between two points that a magnetic flux density in a normal direction of a magnetic field formed in a developer separating magnetic pole in the developing roller become substantially zero, a point at a downstream side in a rotating direction of the developing roller is formed at an upstream side to a developing roller rotating direction, than a line joining the center of the developing roller and the center of the second screw.

19 Claims, 6 Drawing Sheets

FOREIGN PATENT DOCUMENTS

| | | | |
|---|---|---|---|
| JP | 11-194617 | * | 7/1999 |
| JP | 11-202627 | | 7/1999 |
| JP | 11-272062 | | 10/1999 |
| JP | 3127594 | * | 11/2000 |
| JP | 2003-263012 | | 9/2003 |
| JP | 2003263012 A | * | 9/2003 |
| JP | 3795596 | * | 4/2006 |
| JP | 3934792 | * | 3/2007 |
| JP | 4012676 | * | 9/2007 |

* cited by examiner

DEVELOPING DEVICE, PROCESS CARTRIDGE, AND IMAGE FORMING APPARATUS, METHOD OF DEVELOPING LATENT IMAGE

CROSS-REFERENCE TO RELATED APPLICATIONS

The present application claims priority to and incorporates by reference the entire contents of Japanese priority document 2007-334399 filed in Japan on Dec. 26, 2007 and Japanese priority document 2008-242079 filed in Japan on Sep. 22, 2008.

BACKGROUND OF THE INVENTION

1. Field of the Invention

The present invention relates to a developing device that develops an electrostatic latent image carried on an image carrier by a two-component developer including toner and magnetic particles, a process cartridge that includes the developing device, an image forming apparatus that includes the developing device or the process cartridge, and a method of developing a latent image.

2. Description of the Related Art

Developing devices are employed in image forming apparatuses to develop a latent image into a visible tonner image. Some of those developing devices, i.e., two-component developing devices, employ a two-component developer that is a mixture of toner and magnetic particles (hereinafter, referred to as a "carrier"). The two-component developer is typically housed in a developer container. It is preferable that the toner density (developer density) in the developer container be uniform so as to keep the image quality uniform. To maintain the toner density in the developer container uniform, a developer agitating/conveying member that agitates the developer in the developer container is typically provided inside the developer container. The developer in the developer container is then conveyed and supplied to a developer carrier. A plurality of magnetic poles is arranged under the surface of the developer carrier so that the developer, which contains the magnetic particles, magnetically sticks to the surface of the developer carrier. The developer carrier conveys and supplies the developer to an electrostatic latent image on an image carrier. The electrostatic latent image is developed by the toner in the developer and converted into a visual image.

Two screws are typically used as the developer agitating/conveying member: a supplying/collecting screw and an agitating/conveying screw. The supplying/collecting screw and the agitating/conveying screw are arranged in parallel so that the conveying directions thereof are opposite to each other. The supplying/collecting screw supplies the developer in the developer container to the developer carrier. The supplying/collecting screw also collects residual developer, which is the developer that remains on the developer carrier without being conveyed to the image carrier, and delivers the residual developer to the agitating/conveying screw. The agitating/conveying screw conveys the residual developer to a conveying path of the agitating/conveying screw, and the developer is delivered to the supplying/collecting screw, while being mixed and agitated therewith.

In this manner, the developer is circulated while mixing and agitating the developer. However, if the toner and the carrier in the developer are not mixed and agitated sufficiently, a toner density fluctuation and defective charging of the developer occurs. Toner density fluctuation and defective charging leads to an image density fluctuation that in-turn leads to degradation of image quality. The degree of agitation required to prevent such disadvantageous depends on the amount of toner consumption relative to the developer. However, because of the recent trend toward high-speed and down-sizing of image forming apparatus, the amount of toner consumption has increased with respect to the quantity of the developer. Therefore, it has become necessary to increase the degree of agitation even further.

In nowadays, colorization has advanced in electrophotographic image forming apparatuses. To improve the productivity, it is effective to adopt a tandem type image forming apparatus that forms an image by using four cylindrical photosensitive bodies for each color of yellow, magenta, cyan, and black. In the tandem type image forming apparatus, four photosensitive bodies are arranged in the transverse direction, and image creating devices such as a charging device and an exposing device are provided with respect to each of the photosensitive bodies. A developing device is also provided with respect to each of the photosensitive bodies.

To downsize such a tandem type image forming apparatus, the space between adjacent photosensitive bodies needs to be narrowed, and to do so, the size of the developing device also needs to be downsized in the horizontal (transverse) direction. However, with the developing device in which two screws are arranged in the horizontal direction, reducing of size is limited.

In a developing device disclosed in Japanese Patent Application Laid-open No. H11-202627, two agitating/conveying screws are arranged in a vertical direction beside a developing roller, thereby reducing the size in the transverse direction. However, in a typical developing device, the toner is consumed by being adhered on the electrostatic latent image during developing. Accordingly, the residual developer whose toner density is low and the fresh developer, which comes from the developer container, whose toner density is high, are supplied to the developing carrier (roller) at the same time. Because the toner densities of the residual developer and the fresh developer differ, it leads to fluctuation of image density.

To solve such a problem, in a developing device disclosed in Japanese Patent Application Laid-open No. 2003-263012, two agitating/conveying screws are arranged in a vertical direction, and the two screws are separated by arranging a partition plate therebetween. The toner density is made uniform, by supplying the developer by one of the screws, and collecting the developer by the other screw. In this developing device, the toner density is made uniform because the developer is sufficiently mixed and agitated before being supplied to the developer carrier.

However, the amount of developer gradually increases along the shaft direction of the collecting screw. In other words, there is less developer on the upstream side and more developer on the downstream side with respect to the direction of movement of the developer when the developer is move by the collecting screw. Accordingly, overflow and co-rotation of the developer tend to occur at the downstream side. Moreover, in this developing device, a part of the developer conveyed by the supplying screw is supplied to the developer carrier in the way of being conveyed to the downstream side from the upstream side. Accordingly, the amount of developer decreases at the downstream side compared with that at the upstream side, and at the most downstream portion, the height of the uppermost surface of the developer will be lowered. Subsequently, a supply shortage, in other words, a decrease in the amount of developer supplied to the developer carrier at the portion, may occur.

SUMMARY OF THE INVENTION

It is an object of the present invention to at least partially solve the problems in the conventional technology.

According to an aspect of the present invention, there is provided a developing device including a cylindrical developer carrier that rotates on a first shaft, includes a plurality of magnetic poles fixedly arranged therein, carries a developer including magnetic particles and toner, and supplies the developer to an electrostatic latent image formed on an image carrier thereby visualizing the electrostatic latent image; and a cylindrical developer agitating/conveying member that rotates on a second shaft that is parallel to the first shaft, agitates and conveys developer along the second shaft, and includes a function to collect residual developer from the developer carrier and a function to supply fresh developer to the developer carrier, wherein separation of the residual developer from the developer carrier so as to be collected by the developer agitating/conveying member occurs on a line joining a center of rotation of the developer carrier and a center of rotation of the developer agitating/conveying member.

According to another aspect of the present invention, there is provided a process cartridge mounted on an image forming apparatus including an image creating unit that has an image carrier, a charging unit that uniformly charges the image carrier, a latent image forming unit that forms an electrostatic latent image on charged image carrier, a developing unit that develops the electrostatic latent image on the image carrier, and a cleaning unit that cleans a transfer residual toner remained on the image carrier, and detachably arranged with respect to an image forming apparatus main body by being integrally formed with at least one of the image carrier, the charging unit, and the cleaning unit that form the image creating unit, and the developing unit, wherein the above developing device is employed as the developing unit.

According to still another aspect of the present invention, there is provided an image forming apparatus including an image creating unit that has an image carrier, a charging unit that uniformly charges the image carrier, a latent image forming unit that forms an electrostatic latent image on charged image carrier, a developing unit that develops the electrostatic latent image on the image carrier, and a cleaning unit that cleans a transfer residual toner remained on the image carrier, wherein the above developing device is employed as the developing unit.

According to still another aspect of the present invention, there is provided an image forming apparatus including the above process cartridge.

According to still another aspect of the present invention, there is provided a method of developing a latent image by employing a developer containing magnetic particles and toner. The method includes providing a cylindrical developer carrier that rotates on a first shaft, includes a plurality of magnetic poles fixedly arranged therein, carries the developer, and supplies the developer to an electrostatic latent image formed on an image carrier thereby visualizing the electrostatic latent image; providing a cylindrical developer agitating/conveying member that rotates on a second shaft that is parallel to the first shaft, agitates and conveys developer along the second shaft, and includes a function to collect residual developer from the developer carrier and a function to supply fresh developer to the developer carrier; and applying magnet field to the developer carrier in such a manner that separation of the residual developer from the developer carrier so as to be collected by the developer agitating/conveying member occurs substantially on a line joining a center of rotation of the developer carrier and a center of rotation of the developer agitating/conveying member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below in greater detail with reference to the accompanying drawings.

An image forming apparatus in the present patent specification means a copier, a facsimile, a printer, or a multifunction product thereof. Moreover, an image forming apparatus in the present patent specification means a device that employs a developing device. As an example, an embodiment of an electrophotographic image forming apparatus will be described below.

Figure 1:
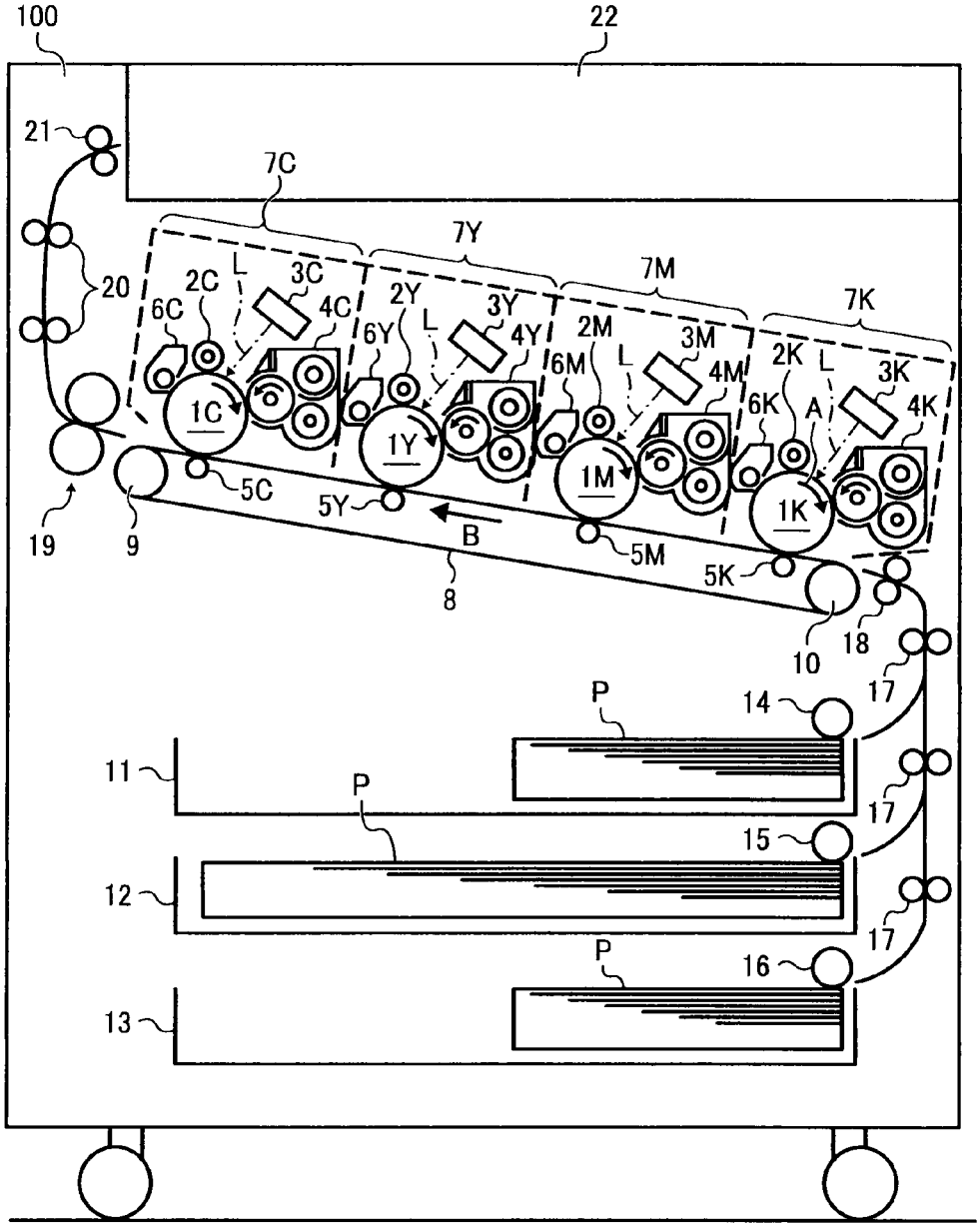
FIG. 1 is a schematic diagram of an image forming apparatus according to an embodiment of the present invention.

FIG. 1 is a schematic diagram of an image forming apparatus 100 that includes a developing device. The image forming apparatus 100 is a tandem type printer that forms a full-color image. Alternatively, the image forming apparatus 100 can be a device that forms a monochrome image. When a document image reading device (scanner) is set on top of the casing thereof, the image forming apparatus (printer) 100 shown in FIG. 1 will be a copier, a facsimile, or a multifunction product thereof.

The image forming apparatus 100 can use any of a regular paper generally used for copying and the like, an overhead projector (OHP) sheet, a 90K paper such as a card and a postcard, a cardboard whose basis weight is equal to or more than approximately 100 g/m$^2$, and a so-called special sheet such as an envelope that has a larger thermal capacity than the regular paper, as a sheet-like recording medium. Hereinafter, all of these will be referred to as a "recording medium".

The image forming apparatus 100 includes image creating devices 7C, 7Y, 7M, and 7K; a transfer device 8; paper-supply cassettes 11, 12, and 13; and registration rollers 18. The image creating devices 7C, 7Y, 7M, and 7K form an image of each color based on image information of a document image read by a reading device (scanner), which is not shown (or image information entered from an outside personal computer and the like). The transfer device 8 is disposed facing the image creating devices 7C, 7Y, 7M, and 7K. The paper-supply cassettes 11, 12, and 13 are recording medium supplying units that supply various types of recording medium P to a transfer area where the image creating devices 7C, 7Y, 7M, and 7K, and the transfer device 8 are facing each other. The registration rollers 18 supply the recording medium P conveyed from the paper-supply cassettes 11, 12, and 13, at the timing that an image is created by the image creating devices 7C, 7Y, 7M, and 7K.

The image forming apparatus 100 also includes a fixing device 19 and a paper ejection tray 22. The fixing device 19 fixes a toner image onto the recording medium, at least at one transfer area among transfer areas where photosensitive drums 1C, 1Y, 1M, and 1K, which will be described later, included in the respective image creating devices 7C, 7Y, 7M, and 7K, and transfer rollers 5C, 5Y, 5M, and 5K of the transfer device 8 are facing each other. The paper ejection tray 22 loads the recording medium P that has passed through the fixing device 19 and on which the toner image is fixed.

The image forming apparatus 100 also includes pick-up rollers 14, 15, and 16; a roller unit 17; discharge rollers 21; and a roller unit 20. The pick-up rollers 14, 15, and 16 send the recording medium P from the paper-supply cassettes 11, 12, and 13, respectively. The roller unit 17 conveys the recording medium P conveyed from the paper-supply cassettes 11, 12, and 13 towards the registration roller 18. The discharge rollers 21 convey the recording medium P towards the paper ejection tray 22, and discharge the recording medium P to the outside of the casing 100. The roller unit 20 conveys the recording medium P output from the fixing device 19 towards the discharge roller 21.

The transfer device 8 is formed of a transfer belt stretched over a plurality of rollers 9 and 10. The transfer device 8 is arranged in an oblique manner to downsize a casing of the image forming apparatus 100 in the left-right direction in FIG. 1. The conveying direction of a sheet-like medium indicated by an arrow B is the oblique direction. Accordingly, the width of the image forming apparatus 100 in the left-right direction in FIG. 1 is slightly longer than the length of an A3 size sheet-like medium in a longitudinal direction. In other words, the image forming apparatus 100 is significantly minimized by being reduced to the minimum size required to accommodate the sheet-like medium therein.

Each of the image creating devices 7C, 7Y, 7M, and 7K forms an image of cyan (C), yellow (Y), magenta (M), and black (K), respectively. Only the color of toner used in the developing devices are different. In other words, the structure of all the developing devices is substantially the same. Here, as a representation of the image creating devices 7C, 7Y, 7M, and 7K, the structure of the black image creating device 7K is explained. The image creating device 7K includes the photosensitive drum 1K as a latent image carrier, which is an image carrier, and a charging device 2K, an exposing device (optical writing device) 3K, a developing device 4K, a cleaning device 6K sequentially disposed in a rotating direction A of the photosensitive drum 1K. The image creating device 7K has a known structure that receives exposure light L from the exposing device (optical writing device) 3K, between the charging device 2K and the developing device 4K. The latent image carrier may be a belt-shaped photosensitive body, instead of a drum-shape.

In the image creating device 7K, the photosensitive drum 1K is charged by the charging device 2K, an electrostatic latent image is formed by irradiating the photosensitive drum 1K with the exposure light L from the exposing device (optical writing device) 3K, and the electrostatic latent image is developed and visualized using the toner in the developing device 4K. The toner image on the photosensitive drum 1K is transferred onto the recording medium P conveyed by the transfer device 8. The processes of charging, exposing, and developing are similarly performed in the image creating devices 7C, 7Y, and 7M, of the other colors, and a toner image of each color is transferred onto the recording medium P conveyed by the transfer device 8. Depending on how many of the image creating devices 7C, 7Y, 7M, and 7K are used, any of a monochrome, a multi-color, and a full-color image is formed on the recording medium P, and the recording medium P is discharged onto the paper ejection tray 22 after being fixed by the fixing device 19.

Structural examples of the developing devices 4C, 4Y, 4M, and 4K used in each of the image creating units (image creating devices) 7C, 7Y, 7M, and 7K of the image forming apparatus 100 will now be described.

Figure 2:
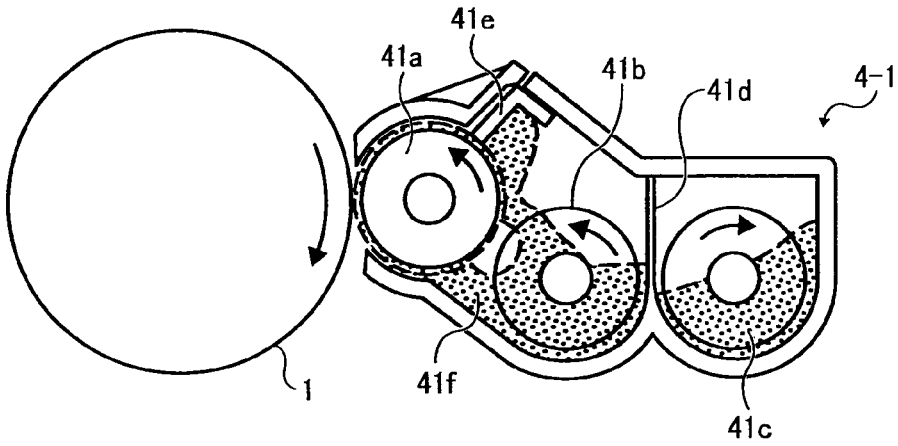
FIG. 2 is a schematic diagram of a structural example of a developing device shown in FIG. 1.

FIG. 2 is a structural example of a developing device 4-1 that uses a two-component developer 41*f* and that can be used as the developing devices 4C, 4Y, 4M, and 4K. The developing device 4-1 includes a developing roller 41*a*, which functions as a developer carrier, a first developer agitating/conveying member 41*b*, and a second developer agitating/conveying member 41*c*. A plurality of magnetic poles (not shown) are arranged on or under the surface of the developing roller 41*a*. The developer (two-component developer) 41*f* that contains magnetic particles and toner affixes to the surface of the developing roller 41*a* because of magnetic attraction. With the rotation of the developing roller 41*a*, the developer on the developing roller 41*a* is conveyed to a photosensitive drum 1 and visualizes an electrostatic latent image formed in advance on the photosensitive drum 1. The photosensitive drum 1 functions as an image carrier. The first developer agitating/conveying member 41*b* rotates on a rotating shaft about a center line parallel to a center line of the shaft of the developing roller 41*a*, agitates and conveys the developer 41*f* in the shaft direction of the rotating shaft, and includes a function of collecting the developer 41*f* from the developing roller 41*a* and a function of supplying the developer to the developing roller 41*a*. The second developer agitating/conveying member 41*c* agitates and conveys the developer 41*f* in a reverse direction from the direction that the first developer agitating/conveying member 41*b* conveys the developer 41*f*. In other words, the first developer agitating/conveying member 41*b* conveys the developer 41*f*, for example, towards the front of the plane, while the second developer agitating/conveying member 41*c* conveys the developer towards the back of the plane. The first developer agitating/conveying member 41*b* and the second developer agitating/conveying member 41*c* are disposed in the substantially horizontal direction. The developing device 4-1 also includes a developer restricting member (doctor) 41*e* arranged above the developing roller 41*a*. The developer restricting member 41*e* restricts the amount of the developer 41*f* to be pumped into the developing roller 41*a* at the downstream side of an area where the developing roller 41*a* and the first developer agitating/conveying member 41*b* are facing each other, in the rotating direction of the developing roller 41*a* that rotates in an anti-clockwise direction in FIG. 2. A partition plate 41*d* is provided between the first developer agitating/conveying member 41*b* and the second developer agitating/conveying member 41*c*. An opening is provided at each end of the partition plate 41*d*, and the developer is delivered to the first developer agitating/conveying member 41*b* and the second developer agitating/conveying member 41*c* via those openings. The developer is circulated while being agitated and conveyed between the first developer agitating/conveying member 41*b* and the second developer agitating/conveying member 41*c*. Although not shown, a toner feeding unit is provided at the upstream side in the conveying direction of the second developer agitating/conveying member 41*c*, and the toner accommodated in a toner accommodating unit, which is not shown, is fed.

The developing roller 41*a* includes a magnetic roller (or a plurality of magnetic rollers). A plurality of magnetic poles are arranged in a circumference direction of the developing roller 41*a*, and a cylinder sleeve, which is not shown, rotates about the periphery. The sleeve is made of a non-magnetic metal such as aluminum. The magnetic roller is fixed so that each of the magnetic poles faces a predetermined direction, and the developer attracted by the magnetic pole is conveyed, while the sleeve rotates about the periphery.

More specifically, the magnetic roller of the developing roller 41*a* includes a main magnetic pole of a developing unit, a conveying magnetic pole, a developer separating magnetic pole, and a developer pumping magnetic pole. The magnetic roller pumps the developer 41*f* agitated and conveyed by the first developer agitating/conveying member 41*b* on the sleeve, by the magnetic force of the developer pumping magnetic pole. Then, the magnetic roller forms a chain-like magnetic brush from the developer on the sleeve, by using the magnetic pole whose polarity is alternately changed. When the sleeve is rotated, the magnetic brush is conveyed to the developing unit by rolling sideways.

In other words, the magnetic field generated by the developer pumping magnetic pole of the magnetic roller of the developing roller 41*a* flows into the adjacent conveying magnetic pole having the reverse polarity. When a carrier made of magnetic particles passes through such a magnetic field, the carrier is magnetized along the magnetic flux density, thereby forming a magnetic brush along the magnetic vector. When the sleeve is rotated at this time, the developer is conveyed on the sleeve while changing its form, along the magnetic vector generated by the magnetic field being formed. The developer conveyed to the developing unit is napped by the magnetic force of the main magnetic pole, thereby forming a magnetic brush. Accordingly, an electrostatic latent image on the photosensitive body is developed by the toner in the developer. The residual developer is conveyed into the developing device by the rotation of the sleeve, passes through the developer separating magnetic pole, and is collected by the first developer agitating/conveying member 41*b*.

In this manner, the developer 41*f* is circulated while being mixed, agitated, and conveyed by the two developer agitating/conveying members 41*b* and 41*c*. The developer is supplied to the developing roller 41*a* and collected from the developing roller 41*a* by the first developer agitating/conveying member 41*b*, and the developer is fed, mixed, and agitated by the second developer agitating/conveying member 41*c*. However, if the fresh developer conveyed by the first developer agitating/conveying member 41*b* and the residual developer collected by the first developer agitating/conveying member 41*b* are not sufficiently mixed and agitated, toner density fluctuation and defective charging can occur. Accordingly, an abnormal image such as an image having an image density fluctuation is formed. In particular, if all the residual developer does not separate from the developing roller 41*a*, and if the residual developer continuously reaches the supplying side by rotating along the developing roller 41*a*, the developer with insufficient toner density is supplied to the developing roller 1. Accordingly, the density of the developed image fluctuates and becomes insufficient. If the developer pumping magnetic pole of the developing roller 41*a* is not suitably positioned, the separated developer is pumped into the developing roller 41*a* before being agitated and conveyed by the first developer agitating/conveying member 41*b*. Similarly, the density of the developed image fluctuates and becomes insufficient.

In the developing device 4-1, the residual developer is effectively separated from the developing roller 41*a*, and the separated developer is supplied again to the developing roller 41*a* after being collected, mixed, and agitated by the first developer agitating/conveying member 41*b*. Moreover, the developer pumping magnetic pole of the developing roller 41*a* is suitably positioned. Accordingly, it is possible to prevent the separated developer from being pumped into the developing roller 41*a*, before being agitated and conveyed by the first developer agitating/conveying member 41*b*.

Figure 3:
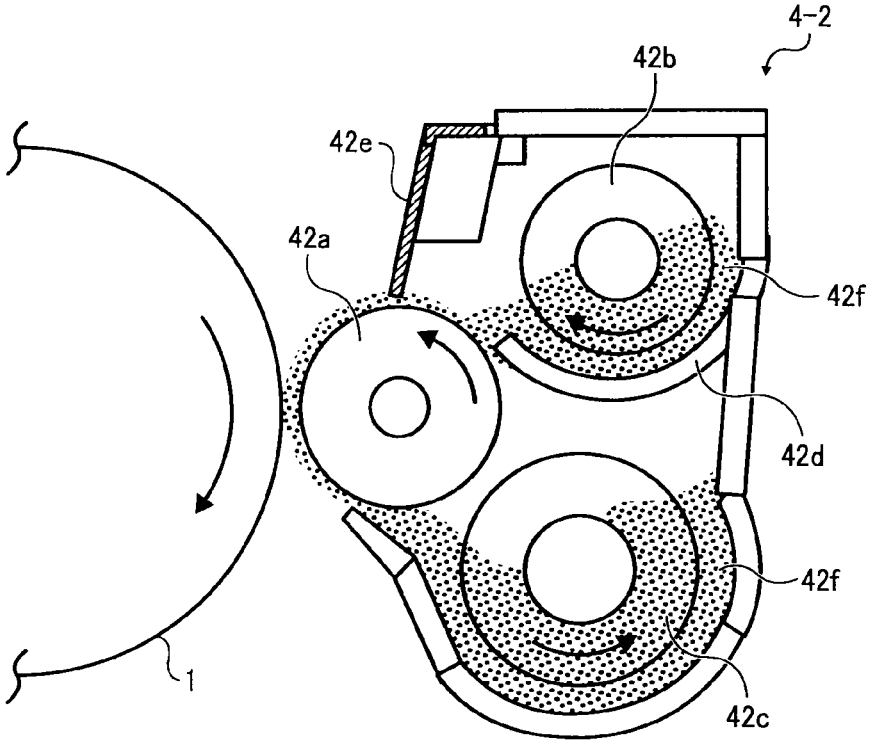
FIG. 3 is a schematic diagram of another structural example of the developing device shown in FIG. 1.

FIG. 3 is a schematic diagram of another structural example of a developing device 4-2 that uses a two-component developer 42*f* and that can be used as the developing devices 4C, 4Y, 4M, and 4K. The developing device 4-2 includes a developing roller 42*a*, which functions as a developer carrier, a first developer agitating/conveying member 42*b*, and a second developer agitating/conveying member 42*c*. A plurality of magnetic poles (not shown) are arranged on or under the surface of the developing roller 41*a*. The developer (two-component developer) 41*f* that contains magnetic particles and toner affixes to the surface of the developing roller 41*a* because of magnetic attraction. With the rotation of the developing roller 42*a*, the developer on the developing roller 42*a* is conveyed to the photosensitive drum 1 and visualizes an electrostatic latent image formed in advance on the photosensitive drum 1. The photosensitive drum 1 functions as an image carrier. The first developer agitating/conveying member 42*b* rotates on the rotating shaft about the center line parallel to the center line of the shaft of the developing roller 42*a*, and supplies the developer 42*f* to the developing roller 42*a*, while agitating and conveying the developer 42*f* in the shaft direction of the rotating shaft. The second developer agitating/conveying member 42*c* collects the developer 42*f* from the developing roller 42*a*, and delivers the developer to the first developer agitating/conveying member 42*b*, while agitating and conveying the developer in a reverse direction from the direction that the first developer agitating/conveying member 42*b* conveys the developer.

In other words, in the developing device 4-2, the structure of the developing roller 42*a* is the same as that in FIG. 2, but the function to supply the developer and the function to collect the developer performed by the developer agitating/conveying members are separated. The developing device 4-2 includes a first agitating/conveying unit (supplying unit) and a second agitating/conveying unit (collecting unit). The first agitating/conveying unit includes the first developer agitating/conveying member 42*b* that agitates and conveys the developer 42*f* made of toner and carrier, and supplies to the developing roller 42*a*. The second agitating/conveying unit includes the second developer agitating/conveying member 42*c* that collects the developer 42*f* from the developing roller 42*a*, mixes the collected developer with the toner fed from a toner feeding opening, which is not shown, and agitates and conveys the mixture. The first agitating/conveying unit (supplying unit) is disposed above the second agitating/conveying unit (collecting unit) and the two are separated by a wall unit 42*d*. The two agitating/conveying units are connected in a vertical direction. In this manner, by connecting the two agitating/conveying units in a vertical direction adjacent to the developing roller 42*a*, the developing device 4-2 can be reduced in size compared with the developing device 4-1 having the structure shown in FIG. 2.

In the developing device 4-2, the developer separated by passing through the developer separating magnetic pole of the developing roller 42*a*, is collected from the developing roller 42*a* by the second developer agitating/conveying member 42*c*. Subsequently, the collected developer is mixed and agitated and supplied to the second agitating/conveying unit (collecting unit) from the toner accommodating unit, which is not shown, via the toner feeding opening, which is not shown, with the collected developer 42*f*. The developer 42*f* conveyed to the end in a shaft direction by the second developer agitating/conveying member 42*c* is delivered to the first developer agitating/conveying member 42*b*, through an opening provided at the end of the wall unit 42*d* in the shaft direction. The developer 42*f* is then agitated and conveyed in the shaft direction by the first developer agitating/conveying member 42*b*. At the conveying path, the developer 42*f* is supplied to the developing roller 42*a*, by the magnetic force of the developer pumping magnetic pole of the developing roller 42*a*. When developing is carried out similarly to that of the developing device in FIG. 2, the residual developer is collected by the second developer agitating/conveying member 42*c* as the above.

In this manner, in the developing device 4-2, the functions to supply and collect the developer performed by the developer agitating/conveying member is separated, and the residual developer is prevented from directly returning to the first developer agitating/conveying member 42*b* used for supplying. Accordingly, the developer 42*f* sufficiently mixed and agitated with the fed toner by the second developer agitating/conveying member 42*c*, and delivered to the first developer agitating/conveying member 42*b* is supplied to the developing roller 42*a*. Subsequently, it is possible to obtain an image with stable image density.

In the system in which the developer is supplied by the first developer agitating/conveying member 42*b* while being agitated and conveyed in the shaft direction, and the developer is collected, and mixed and agitated with the fed toner, by the second developer agitating/conveying member 42*c*, the sufficiently mixed and agitated developer can be supplied to the developing roller 42*a*. Accordingly, the toner density becomes uniform, and it is possible to obtain an image with stable image density.

However, in such a developing device with the circulation system in which supply and collection are separated, in the second developer agitating/conveying member 42*c* used for collecting, the amount of developer is gradually increased, as the collected developer is conveyed towards the downstream side from the upstream side in the shaft direction (conveying direction). Accordingly, at the downstream side in the conveying direction of the second developer agitating/conveying member 42*c*, overflow and co-rotation of the developer tend to occur.

In the developing device, in the first developer agitating/conveying member 42*b* used for supplying, a part of the developer is supplied to the developing roller 42*a* while the developer is conveyed to the downstream side from the upstream side in the conveying direction. Accordingly, the amount of developer at the downstream side is reduced compared with the upstream side, and the height of the uppermost surface of the developer is lowered at the most downstream portion. Subsequently, a supply shortage, in other words, a decrease in supply of the developer to the developing roller 42*a* at the portion, may occur.

In the present invention, in the developing device having the structure as shown in FIG. 3, the collected residual developer is effectively separated and the developer can be smoothly collected from the developing roller 42*a*. Accordingly, it is possible to prevent overflow and co-rotation of the developer from occurring. It is also possible to smoothly supply the developer to the developing roller 42*a*, thereby solving problems such as insufficient development, due to excessive supply and supply shortage. The developer is smoothly supplied and collected with respect to the developing roller 42*a*, and overflow and co-rotation of the developer can be prevented. The problem such as insufficient development due to excessive supply and supply shortage can also be solved. A specific structure is described in a second embodiment of the present invention below.

A first embodiment that corresponds to sixth to ninth units will now be explained. In the present embodiment, by minimizing the developing roller and the like, a space between the developing roller and the developer agitating/conveying member (such as agitating/conveying screw) that includes either or both functions of collecting and supplying developer is narrowed. Even if the developer is filled between the developing roller and the agitating/conveying screw, the developer can be effectively delivered (collected or supplied) between the developing roller and the agitating/conveying screw.

As a specific structure, hardly any magnetic binding force should be generated on the developing roller positioned at a line joining the center of the developing roller and the center of the agitating/conveying screw. In other words, on the developing roller positioned at the line joining the center of the developing roller and the center of the agitating/conveying screw, there is no magnetic flux density in the normal direction in a magnetic field formed in the developer separating magnetic pole and a magnetic field formed in the developer pumping magnetic pole. Accordingly, on the line joining the center of the developing roller and the center of the agitating/conveying screw, the developer is separated from the developing roller.

Figure 4:
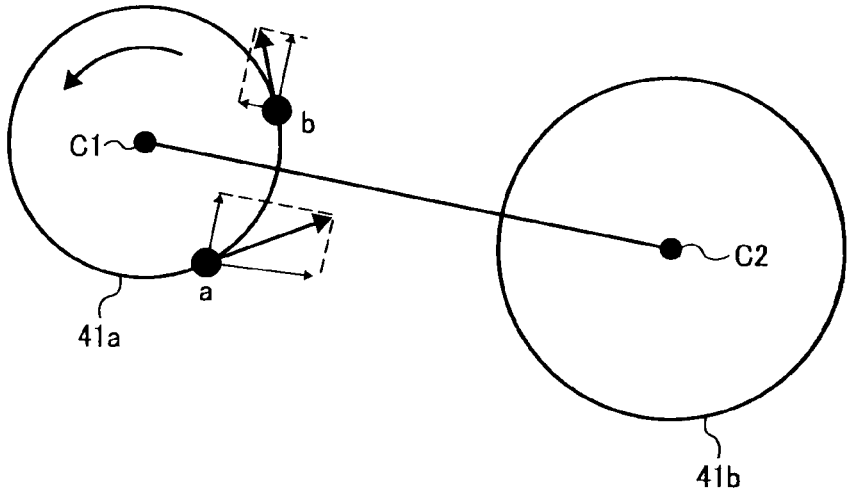
FIG. 4 is a schematic for explaining a relationship between the action of centrifugal force at a developer separating position and a developer pumping position of a developing roller, and a developer agitating/conveying member in the developing device shown in FIG. 2.

As an example, as shown in FIG. 4, in the developing roller 41*a*, because the sleeve rotates at a high speed, the centrifugal force acts in a tangential direction. If a point a in FIG. 4 is the position of the developer separating magnetic pole, and a point b is the position of the developer pumping magnetic pole, the centrifugal force at each point is separated in the direction of the agitating/conveying screw 41*b*, and in the direction perpendicular thereto. Accordingly, it is possible to understand whether the centrifugal force acts so as to take the developer into the developing roller, or acts so as to deliver the developer to the agitating/conveying screw 41*b*.

For example, in FIG. 4, the centrifugal force at the point a, or the component in the direction of the agitating/conveying screw, acts in the direction towards the agitating/conveying screw 41*b* from the developing roller 41*a* (referred to as "positive"). On the other hand, the centrifugal force at the point b acts in the direction towards the developing roller 41*a* from the agitating/conveying screw 41*b* (referred to as "negative").

When the residual developer is delivered to the agitating/conveying screw 41*b* from the developing roller 41*a*, it is preferable that the component of the centrifugal force in the direction of the agitating/conveying screw, from the position at the point a to the position of the line joining a center C1 of the developing roller 41*a* and a center C2 of the agitating/conveying screw 41*b* becomes positive. If the component of the centrifugal force in the direction of the agitating/conveying screw is not generated at the position of the line joining the center C1 of the developing roller 41*a* and the center C2 of the agitating/conveying screw 41*b*, negative centrifugal force is not generated, thereby enabling to deliver the developer smoothly.

To satisfy such a condition, hardly any magnetic binding force should be generated on the developing roller positioned at the line joining the center C1 of the developing roller 41*a* and the center of the agitating/conveying screw 41*b*. More specifically, between two points that the magnetic flux density in the normal direction of the magnetic field formed in the developer separating magnetic pole in the developing roller become substantially zero (points at both sides (upstream side and downstream side) in the developing roller rotating direction interposing a location where the magnetic flux density in the normal direction becomes maximum), the point at the downstream side in the rotating direction of the developing roller 41*a* is formed at the upstream side with respect to the rotating direction of the developing roller 41*a*, than the line joining the center C1 of the developing roller 41*a* and the center of the agitating/conveying screw 41*b*. In this manner, at an area of the line joining the center C1 of the developing roller 41*a* and the center C2 of the agitating/conveying screw 41*b*, the binding force due to the magnetic force is substantially zero, or practically none. Accordingly, it is possible to eliminate the force that attracts the developer to the sleeve, thereby enabling to effectively separate the developer. Subsequently, it is possible to smoothly deliver (collect) the developer to the agitating/conveying screw 41*b* from the developing roller 41*a*, and prevent co-rotation of developer. To effectively eliminate the force that attracts the developer to the sleeve (magnetic binding force) at the area of the line joining the center C1 of the developing roller 41*a* and the center C2 of the agitating/conveying screw 41*b*, it is preferable to make the magnetic flux density in the normal direction on the sleeve of the magnetic field formed in the developer separating magnetic pole to 0 mT (millitesla), or at least equal to or less than 5 mT, that does not affect holding the carrier.

When the developer agitated and conveyed by the agitating/conveying screw 41*b* is delivered to the developing roller 41*a* from the agitating/conveying screw 41*b*, it is preferable that the component of the centrifugal force in the direction of the agitating/conveying screw, from the position of the line joining the center C1 of the developing roller 41*a* and the center C2 of the agitating/conveying screw 41*b*, to the position of the point b gradually becomes negative.

This is because, contrary to the collection of developer, at the area of the pumping magnetic pole of the point b, an attraction of magnetic force and a wraparound of centrifugal force need to be formed.

To satisfy such a condition, between the two points that the magnetic flux density in the normal direction of the magnetic field formed in the developer pumping magnetic pole in the developing roller become substantially zero (points at both sides (upstream side and downstream side) in the developing roller rotating direction interposing a location where the magnetic flux density in the normal direction becomes maximum), the point at the upstream side in the rotating direction of the developing roller 41*a* is formed at the downstream side with respect to the rotating direction of the developing roller 41*a*, than the line joining the center C1 of the developing roller 41*a* and the center of the agitating/conveying screw 41*b*. In this manner, by forming a magnetic field at the downstream side than the line joining the center C1 of the developing roller 41*a* and the center of the agitating/conveying screw 41*b*, the wraparound to the top of the developing roller of the developer occurs. In particular, with the developing device in which the pumping position and the doctor position are adjacently formed, it is possible to restrict the developer smoothly. When the magnetic field formed in the developer pumping magnetic pole and the negative centrifugal force component on the sleeve thereby are present at the upstream side than the line joining the center C1 of the developing roller 41*a* and the center of the agitating/conveying screw 41*b*, the developer that has passed the point a and separated from the developing roller 41*a* is attracted to the developing roller 41*a* before being collected by the agitating/conveying screw 41*b*. Accordingly, the flow of the developer at the delivery will be hampered. Subsequently, at the area joining the center C1 of the developing roller 41*a* and the center of the agitating/conveying screw 41*b*, it is preferable that there is no magnetic flux density in the normal direction.

Figure 5:
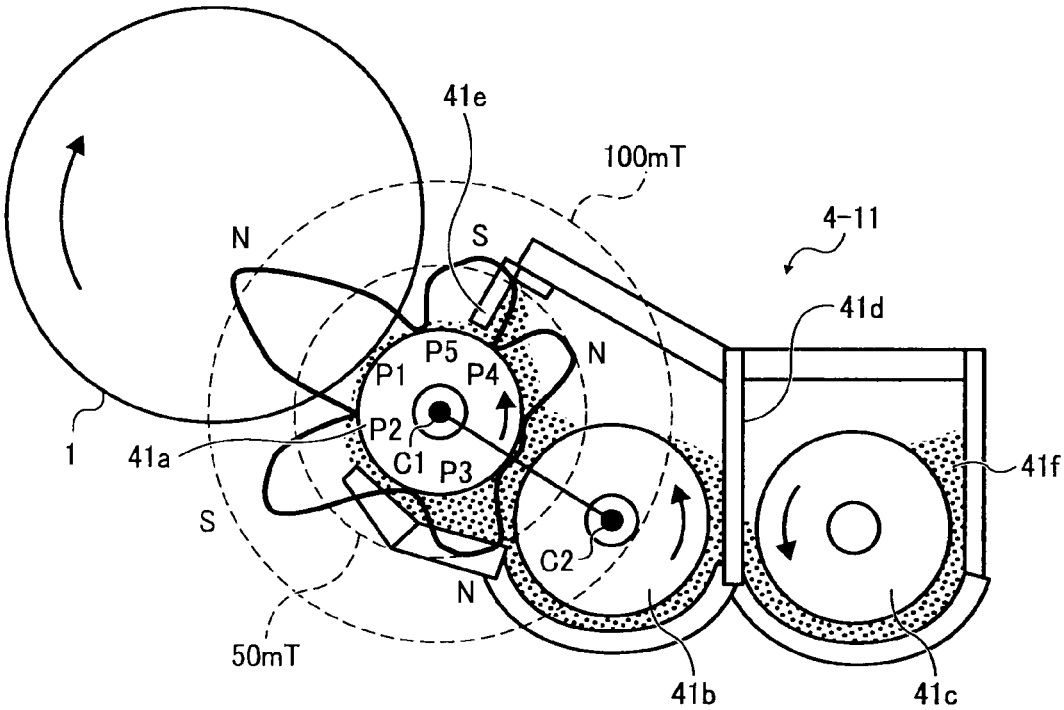
FIG. 5 is a schematic diagram of still another structural example of the developing device shown in FIG. 1.

If the position of the magnetic field formed in the developer pumping magnetic pole is not suitable and the developer cannot be supplied to the developing roller 41*a* smoothly, the supply amount deviates largely by the position of the agitating/conveying screw 41*b* and the like. Accordingly, the density varies by a screw pitch (screw pitch fluctuation). FIG. 5 is a schematic diagram of a developing device 4-11 for explaining the magnetic pole position of the magnetic roller and the magnetic field distribution inside the developing roller 41*a*. The developing device 4-11 has basically the same structure as the developing device 4-1 shown in FIG. 2. In the developing device 4-11, P1 is a developing main magnetic pole and it is a north (N) pole, P2 is a conveying magnetic pole and it is a south (S) pole, P3 is a developer separating magnetic pole and it is the N pole, P4 is a developer pumping magnetic pole and it is the N pole, and P5 is a conveying magnetic pole and it is the S pole.

In the developing device 4-11, the developer 41*f* agitated and conveyed by the first developer agitating/conveying member (such as first agitating/conveying screw) 41*b* is pumped on the sleeve of the developing roller 41*a* by the magnetic force of the developer pumping magnetic pole P4. Then, the developer 41*f* is conveyed with the rotation of the sleeve in an arrow direction in FIG. 5, and thinned because the thickness of the layer is restricted by the developer restricting member (doctor) 41*e*. The thinned developer is conveyed to the developing position facing the photosensitive drum 1 by the magnetic force of the conveying magnetic pole P5 and the rotation of the sleeve, and napped by magnetic force of the developer main magnetic pole P1 to form a magnetic brush. A developing bias is applied to the developing roller 41*a* by a power source, which is not shown. At the developing position, the toner in the developer is supplied to an electrostatic latent image formed on the surface of the photosensitive body, and the electrostatic latent image is visualized and developed. A developing gap GP that is a gap of the sleeve between the photosensitive drum 1 and the developing roller 41*a* may be set in a range between 0.8 millimeter (mm) and 0.4 mm, and it is also possible to improve developing efficiency by making the value smaller.

As concrete example, the diameter of the photosensitive drum 1 is set to 50 mm and the linear speed to 200 mm/s. The diameter of the sleeve of the developing roller 41*a* is set to 18 mm and the linear speed to 300 mm/s. The predominant linear speed of the sleeve of the developing roller 41*a* is 200 to 300 mm/s.

The developing is carried out by setting a charging potential V0 of the photosensitive drum 1 before being exposed to −350 volts, a potential VL after being exposed to −50 volts, and a developing bias voltage VB to −250 volts, in other words, as a developing potential (VL−VB=200). At this time, it is |VD−VL|>|VL−VB|.

The two magnetic poles adjacent to the first agitating/conveying screw 41*b*, in other words, the developer separating magnetic pole P3 and the developer pumping magnetic pole P4 have the same N polarity. There is hardly any magnetic binding force on the developing roller at the position of the line joining the center C1 of the developing roller 41*a* and the center C2 of the first agitating/conveying screw 41*b*.

More specifically, between the two points that the magnetic flux density in the normal direction of the magnetic field formed in the developer separating magnetic pole P3 in the developing roller 41*a* become substantially zero (points at both sides (upstream side and downstream side) in the developing roller rotating direction interposing a location where the magnetic flux density in the normal direction becomes maximum), the point at the downstream side in the rotating direction of the developing roller 41*a* is formed at the upstream side with respect to the rotating direction of the developing roller 41*a*, than the line joining the center C1 of the developing roller 41*a* and the center C2 of the first agitating/conveying screw 41*b*. Between the two points that the magnetic flux density in the normal direction of the magnetic field formed in the developer pumping magnetic pole P4 in the developing roller 41*a* become substantially zero (points at both sides (upstream side and downstream side) in the developing roller rotating direction interposing a location where the magnetic flux density in the normal direction becomes maximum), the point at the upstream side in the rotating direction of the developing roller 41*a* is formed at the downstream side with respect to the rotating direction of the developing roller 41*a*, than the line joining the center C1 of the developing roller 41*a* and the center C2 of the agitating/conveying screw 41*b*.

In this manner, on the developing roller 41*a* at the position of the line joining the center C1 of the developing roller 41*a* and the center C2 of the first agitating/conveying screw 41*b*, the magnetic flux density in the normal direction is substantially zero and there is hardly any magnetic binding force. Accordingly, in the developing device 4-11, it is possible to effectively separate the developer, and collect the developer in the first agitating/conveying screw 41*b*, at the area between the developer separating magnetic pole P3 at the upstream side in the sleeve rotating direction of the developing roller 41*a*, and the upstream side of the line joining the center C1 of the developing roller 41*a* and the center of the first agitating/conveying screw 41*b*. It is also possible to effectively pump the developer 41*f* agitated and conveyed by the first agitating/conveying screw 41*b*, at the downstream side of the line joining the center C1 of the developing roller 41*a* and the center of the first agitating/conveying screw 41*b*, at the area up to the developer pumping magnetic pole P4.

In this manner, in the developing device 4-11, even when the agitating/conveying screw 41*b* that includes functions of collecting and supplying the developer is used, the separating (collect) and pumping (supply) of the developer can be carried out effectively. Accordingly, even if a situation arises where the developer 41*f* is filled to the level of the upper surface of the first agitating/conveying screw 41*b*, and the developing roller 41*a* is filled with the developer at the level, it is possible to collect the residual developer effectively. Accordingly, the developer agitated by the agitating/conveying screw 41*b* can be supplied to the developing roller.

The developing device 4-11 was incorporated in an image forming apparatus and an experiment was carried out in which black images were continuously output for one minute by using this image forming apparatus. At this time, by a toner feeding function, which is not shown, toner is suitably fed to the second agitating/conveying screw 41*c*.

As a result of the experiment, the density difference between the image density of the first sheet and the image density thereof after being output for one minute was 0.1, and even when images are continuously output, it was possible to obtain a good image density.

Figure 6:
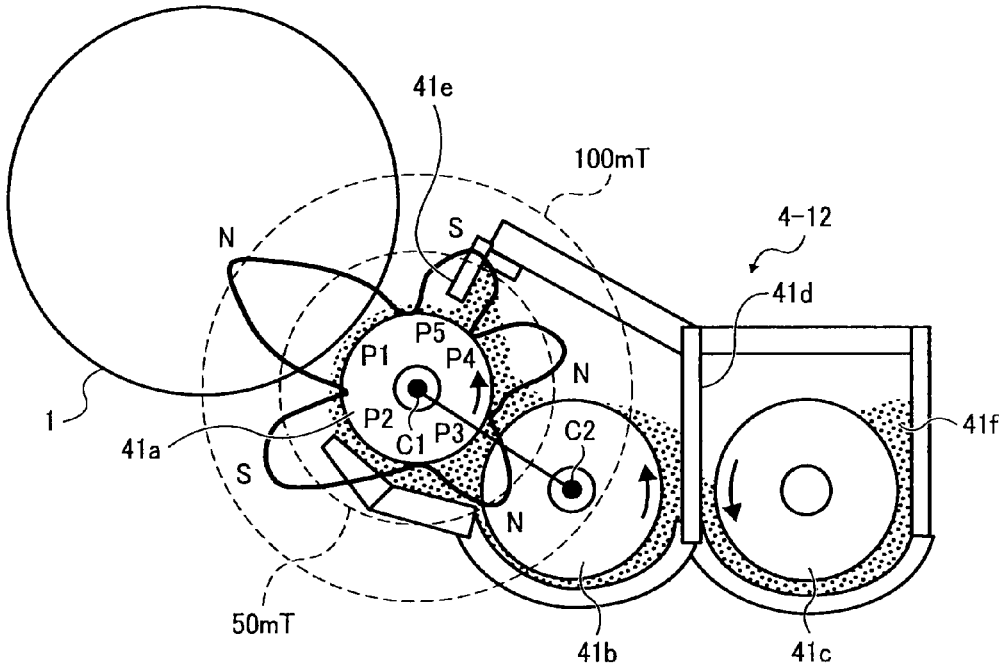
FIG. 6 is a schematic diagram of still another structural example of the developing device shown in FIG. 1.

FIG. 6 depicts a developing device 4-12 as a variant of the developing device 4-11. The developing device 4-12 has basically the same structure as the developing device 4-11 shown in FIG. 6. In the developing device 4-12, the positions of the developer separating magnetic pole P3 and the developer pumping magnetic pole P4 are shifted to the downstream side in the rotating direction of the developing roller 41*a*. Then, the similar experiment is carried out by using a developing device 4-12 formed so that between the two points that the magnetic flux density in the normal direction of the magnetic field formed in the developer separating magnetic pole P3 in the developing roller 41*a* become substantially zero, the point at the downstream side in the rotating direction of the developing roller 41*a* is formed at the downstream side with respect to the rotating direction of the developing roller 41*a*, than the line joining the center C1 of the developing roller 41*a* and the center C2 of the first agitating/conveying screw 41*b*. In the developing device 4-12, the magnetic binding force generated by the developer separating magnetic pole P3 still remains at the position of the line joining the center C1 of the developing roller 41*a* and the center C2 of the first agitating/conveying screw 41*b*. Accordingly, co-rotation of the residual developer occurred.

Therefore, when black images are continuously output for one minute using an image forming apparatus applied with the developing device 4-12, the density difference between the image density of the first sheet and the image density thereof after being output for one minute was 0.9. Accordingly, when images are output continuously, a problem that the density becomes insufficient occurred.

Figure 7:
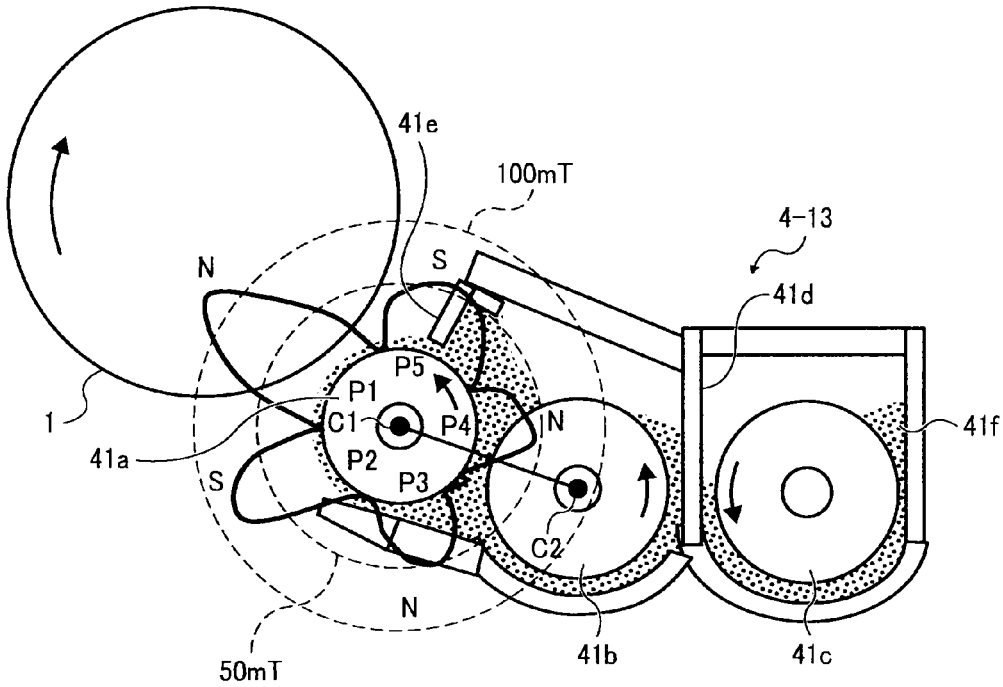
FIG. 7 is a schematic diagram of still another structural example of the developing device shown in FIG. 1.

FIG. 7 depicts a developing device 4-13 as another variant of the developing device 4-11. The developing device 4-13 has basically the same structure as the developing device 4-11 shown in FIG. 6. In the developing device 4-13, the positions of the developer separating magnetic pole P3 and the developer pumping magnetic pole P4 are shifted to the upstream side in the rotating direction of the developing roller 41*a*. Then, the similar experiment is carried out by using a developing device 4-13 formed so that between the two points that the magnetic flux density in the normal direction of the magnetic field formed in the developer pumping magnetic pole P4 in the developing roller 41*a* become substantially zero, the point at the upstream side in the rotating direction of the developing roller 41*a* is formed at the upstream side with respect to the rotating direction of the developing roller 41*a*, than the line joining the center C1 of the developing roller 41*a* and the center C2 of the first agitating/conveying screw 41*b*. In the developing device 4-13, the magnetic binding force by the developer pumping magnetic pole P4 is generated at the position of the line joining the center C1 of the developing roller 41*a* and the center C2 of the first agitating/conveying screw 41*b*. Accordingly, a situation that a part of the developer temporarily separated from the developing roller 41*a* is pumped into the sleeve before being collected and agitated by the first agitating/conveying screw 41*b* has occurred.

As a result, when black images are continuously output for one minute using an image forming apparatus applied with the developing device 4-13, a problem of density fluctuation occurred. Accordingly, a problem of screw pitch fluctuation occurred, when images are output continuously.

Figure 8:
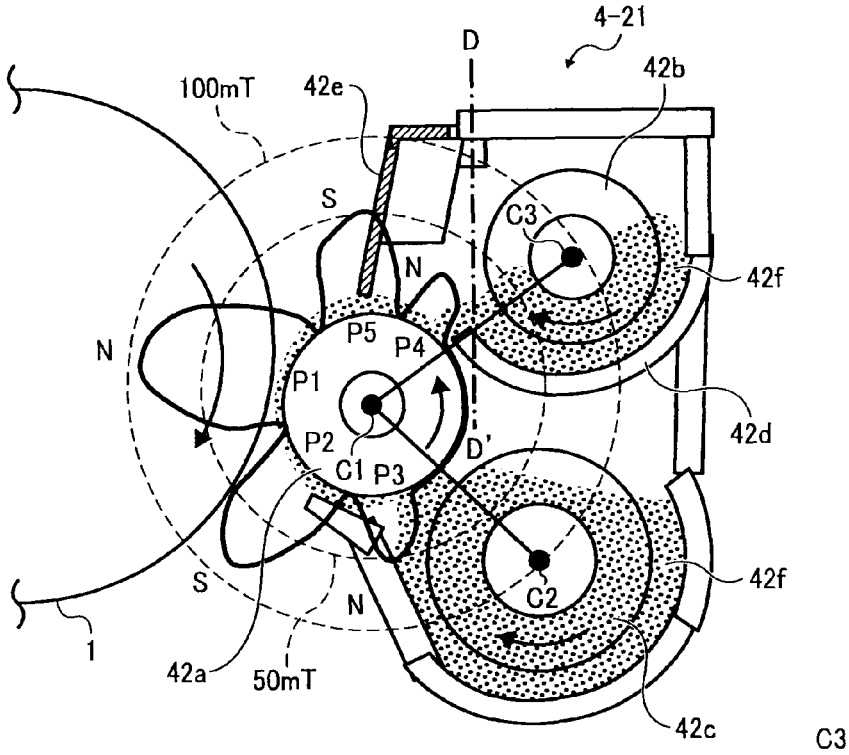
FIG. 8 is a schematic diagram of still another structural example of the developing device shown in FIG. 1.

FIG. 8 is a schematic diagram of a developing device 4-21. The developing device 4-21 has basically the same structure as the developing device 4-2 shown in FIG. 3. The developing device 4-21 includes the developing roller 42*a*, the first developer agitating/conveying member (such as first agitating/conveying screw) 42*b*, and the second developer agitating/conveying member (such as second agitating/conveying screw) 42*c*. The developing roller 42*a* includes a magnetic roller (or a plurality of magnets) that has a plurality of magnetic poles P1 to P5 fixedly arranged therein, and a developing sleeve rotatably supported at the periphery. The developing roller 42*a* carries and rotates the two-component developer 42*f* that includes magnetic particles and toner, and visualizes an electrostatic latent image by supplying the toner to the electrostatic latent image formed on the photosensitive drum 1. The first agitating/conveying screw 42*b* rotates on a rotating shaft about the center line parallel to the center line of the shaft of the developing roller 42*a*, and supplies the developer 42*f* to the developing roller 42*a*, while agitating and conveying the developer 42*f* in the shaft direction of the rotating shaft. The second agitating/conveying screw 42*c* collects the developer 42*f* from the developing roller 42*a*, and delivers the developer to the first agitating/conveying screw 42*b* while agitating and conveying the developer in a reverse direction from the direction that the first agitating/conveying screw 42*b* conveys the developer. In the developing device 4-21, the magnetic pole positions of the magnetic roller and the magnetic field distribution inside the developing roller 42*a* are shown. P1 is the developing main magnetic pole and it is a N pole, P2 is the conveying magnetic pole and it is a S pole, P3 is the developer separating magnetic pole and it is a N pole, P4 is the developer pumping magnetic pole and it is a N pole, and P5 is the conveying magnetic pole and it is a S pole.

In the developing device 4-21, the function to supply and collect the developer 42*f* is separated by the two agitating/conveying screws 42*b* and 42*c*. The developing device 4-2 includes a first agitating/conveying unit (supplying unit) and a second agitating/conveying unit (collecting unit). The first agitating/conveying unit includes the first agitating/conveying screw 42*b* that agitates and conveys the two-component developer 42*f* made of toner and carrier, and supplies to the developing roller 42*a*. The second agitating/conveying unit includes the second agitating/conveying screw 42*c* that that collects the developer 42*f* from the developing roller 42*a*, mixes the collected developer with the toner fed from a toner feeding opening, which is not shown, and agitates and conveys the mixture. The first agitating/conveying unit (supplying unit) is arranged above the second agitating/conveying unit (collecting unit) and partitioned by the wall unit 42*d* for partitioning, and the two agitating/conveying units are connected in a vertical direction. In this manner, by connecting the two agitating/conveying units in a vertical direction alongside the developing roller 42*a*, the developing device 4-21 can be reduced in size compared with the developing device 4-11 having the structure of the first embodiment.

In the developing device 4-21, the first agitating/conveying screw 42*b* and the second agitating/conveying screw 42*c* are facing the developing roller 42*a* at an intermediate section therebetween, and the first agitating/conveying screw 42*b* is rotatably supported so as to position at the downstream side in the rotating direction of the developing roller 42*a*, with respect to the second agitating/conveying screw 42*c*. The developer pumping magnetic pole P4 of the developing roller 42*a* pumps the developer 42*f* on the sleeve from the first agitating/conveying screw 42*b*. The developer separating magnetic pole P3 of the developing roller 42*a* drops the developer that has passed through the developing area facing the photosensitive drum 1, on the second agitating/conveying screw 42*c*.

In the developing device 4-21, as shown in FIG. 8, between the two points that the magnetic flux density in the normal direction of the magnetic field formed in the developer separating magnetic pole P3 in the developing roller 42*a* become substantially zero (points at both sides (upstream side and downstream side) in the developing roller rotating direction interposing a location where the magnetic flux density in the normal direction becomes maximum), the point at the downstream side in the rotating direction of the developing roller 42*a* is formed at the upstream side with respect to the rotating direction of the developing roller 42*a*, than the line joining a center C1 of the developing roller 42*a* and a center C2 of the second agitating/conveying screw 42*c*. Moreover, between the two points that the magnetic flux density in the normal direction of the magnetic field formed in the developer pumping magnetic pole P4 in the developing roller 42*a* become substantially zero (points at both sides (upstream side and downstream side) in the developing roller rotating direction interposing a location where the magnetic flux density in the normal direction becomes maximum), the point at the upstream side in the rotating direction of the developing roller 42*a* is formed at the downstream side with respect to the rotating direction of the developing roller 42*a*, than the line joining the center C1 of the developing roller 42*a* and a center C3 of the first agitating/conveying screw 42*b*. Accordingly, there is hardly any magnetic binding force at an area from the position of the line joining the center C1 of the developing roller 42*a* and the center C2 of the second agitating/conveying screw 42*c*, to the position of the line joining the center C1 of the developing roller 42*a* and the center C3 of the first agitating/conveying screw 42*b*.

In other words, in the developing device 4-21, the pumping magnetic pole P4 and the developer separating magnetic pole P3 have the same polarity. Accordingly, a repulsive magnetic field is formed between the pumping magnetic pole P4 and the developer separating magnetic pole P3, thereby separating the developer. No other magnetic field is present between the pumping magnetic pole P4 and the developer separating magnetic pole P3. In other words, the pumping magnetic pole P4 and the developer separating magnetic pole P3 are adjacent to each other.

Therefore, in between the point at the downstream side in the rotating direction of the developing roller 42*a* between the two points that the magnetic flux density in the normal direction of the magnetic field formed in the developer separating magnetic pole P3 become substantially zero, and the point at the upstream side in the rotating direction of the developing roller 42*a* between the two points that the magnetic flux density in the normal direction of the magnetic field formed in the pumping magnetic pole P4 become substantially zero, there is no magnetic force that adsorbs the developer 42*f* on the sleeve, or there is only a weak magnetic field that cannot hold and rotate the developer 42*f* along therewith.

In the present patent specification, the term "magnetic flux density in the normal direction becomes substantially zero" means that the magnetic flux density in the normal direction can only generate a weak magnetic field that cannot hold and rotate the developer along therewith as the above.

In the developing device 4-21, all the developer 42*f* that has passed through the developing area are returned to the side of the second agitating/conveying screw 42*c* after passing through the developer separating magnetic pole P3. Accordingly, the developer 42*f* at the side of the first agitating/ conveying screw 42*b* is in a refresh (initialized) state not being used for developing, and delivered to the first agitating/conveying screw 42*b* after being mixed and agitated with the fed toner by the second agitating/conveying screw 42*c*. Accordingly, the toner density is not lowered. Therefore, the toner density at the side of the first agitating/conveying screw 42*b* is always constant from the upstream side to the downstream side. Because the toner density on the sleeve of the developing roller 42*a* does not vary, it is possible to obtain a uniform image with good density follow-up and without density difference. The developer conveyed to the developing area is agitated sufficiently, pumped up from the side of the first agitating/conveying screw 42*b*, and passed through the area facing a doctor 42*e* only once. Accordingly, the charging conditions are equal, and the charging amount varies a little. Because the toner is uniformly charged, it is possible to form a good quality image free from toner scattering, ground stain, and detailed image fluctuations.

In the second agitating/conveying screw 42*c* used for collecting, although the amount of developer is small at the upstream side in the developer conveying direction, because the developer is collected from the developing roller 42*a*, the amount of developer increases gradually, as the collection progresses. Therefore, at the downstream in the developer conveying direction of the second agitating/conveying screw 42*c*, the developer overflows between the second agitating/conveying screw 42*c* and the developing roller 42*a*. Accordingly, co-rotation tends to occur. However, in the present embodiment, between the two points that the magnetic flux density in the normal direction of the magnetic field formed in the developer separating magnetic pole P3 in the developing roller 42*a* become substantially zero, the point at the downstream side in the rotating direction of the developing roller 42*a* is formed at the upstream side with respect to the rotating direction of the developing roller 42*a*, than the line joining the center C1 of the developing roller 42*a* and the center C2 of the second agitating/conveying screw 42*c*. Accordingly, there is hardly any magnetic binding force at the position of the line joining the center C1 of the developing roller 42*a* that has passed through the developer separating magnetic pole P3 and the center C2 of the second agitating/conveying screw 42*c*. Subsequently, the developer is smoothly separated from the developing roller 42*a*, and the developer can be smoothly collected from the developing roller 42*a*, regardless of the level of the developer in the collecting unit. Accordingly, it is possible to prevent overflow and co-rotation of the developer from occurring. There is also hardly any magnetic binding force at the position of the line joining the center C1 of the developing roller 42*a* and the center C3 of the first agitating/conveying screw 42*b*. Accordingly, the residual developer whose toner density is lowered is not directly pumped into the developing roller 42*a*, but the developer collected, and mixed and agitated with the toner by the second agitating/conveying screw 42*c*, and delivered to the first agitating/conveying screw 42*b* and agitated and conveyed thereby, can be pumped into the developing roller 42*a*.

In the developing device 4-21 according to the present embodiment, even in a downsized developing device 4-21 that has the developing system in which the functions of collecting and supplying are separated, the toner is mixed and agitated by the second agitating/conveying screw 42*c* having the collecting function, and the developer is supplied by the first agitating/conveying screw 42*b* having the supplying function, the magnetic binding force that prevents the developer from conveying is not formed with respect to the developer on the first agitating/conveying screw 42*b* and the second agitating/conveying screw 42*c*. Accordingly, it is possible to mix, agitate, convey, and circulate the developer smoothly. Between the two points that the magnetic flux density in the normal direction of the magnetic field formed in the developer pumping magnetic pole P4 in the developing roller 42*a* become substantially zero, the point at the upstream side in the rotating direction of the developing roller 42*a* is formed at the downstream side with respect to the rotating direction of the developing roller 42*a*, than the line joining the center C1 of the developing roller 42*a* and the center C3 of the first agitating/conveying screw 42*b*. Accordingly, it is possible to prevent excessive supply at the upstream side in the conveying direction of the first agitating/conveying screw 42*b*, and a supply shortage at the downstream side in the conveying direction thereof. Thus, a suitable amount of developer can be supplied to the developing roller 42*a*. Subsequently, it is possible to solve the problems such as image density fluctuations, due to insufficient mixing and agitating, and supply shortage of the developer.

In the developing device 4-21, in the first agitating/conveying screw 42*b* used for supplying the developer to the developing roller 42*a*, although the amount of developer is large at the upstream in the developer conveying direction, because the developer is supplied to the developing roller 42*a*, the amount of developer decreases gradually as moving towards the downstream side. Therefore, an excessive supply of developer may occur at the upstream side in the developer conveying direction and a supply shortage thereof may occur at the downstream side. In particular, if the developer is not smoothly supplied at the downstream side, it may result in a screw pitch fluctuation due to an insufficient amount of the developer, and at worst, an undeveloped area. Accordingly, in the present embodiment, in addition to the above structure, the end position of the wall unit 42*d* at the developer supplying side in the first agitating/conveying screw 42*b* is restricted, as well as tilted, depending on the level of the developer.

Figure 9:
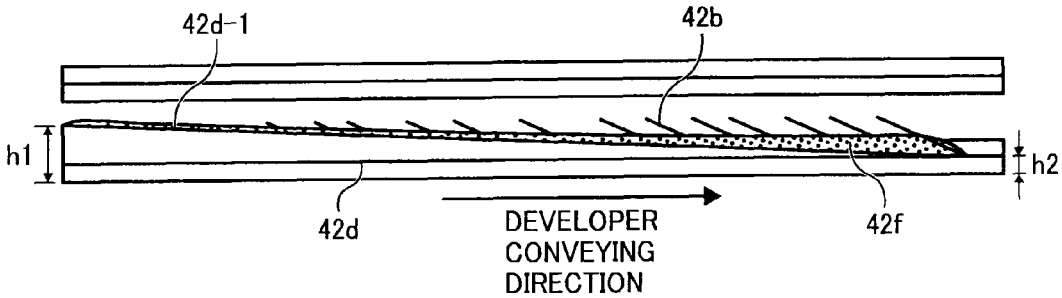
FIG. 9 is a conceptual diagram of a section taken along a line D-D' in FIG. 8.

FIG. 9 is a conceptual diagram of a section taken along a line D-D' in FIG. 8. As shown in FIG. 9, the position of a developer supplying side end 42*d*-1 of the wall unit 42*d* that partitions the first agitating/conveying screw 42*b* and the second agitating/conveying screw 42*c* is formed at least above the line joining the center C1 of the developing roller 42*a* and the center C3 of the first agitating/conveying screw 42*b*. Accordingly, it is possible to effectively prevent excessive supply of developer at the upstream side in the conveying direction of the first agitating/conveying screw 42*b*.

Moreover, the height of the developer supplying side end 42*d*-1 of the wall unit 42*d* is made, so as a height h2 at the downstream side is made lower than a height h1 at the upstream side in the developer conveying direction of the first agitating/conveying screw 42*b* (h1>h2). Accordingly, even if the amount of developer decreases at the downstream side, it is possible to efficiently supply the developer to the developing roller 42*a*, and it is possible to effectively prevent supply shortage at the downstream side in the conveying direction. Subsequently, it is possible to effectively solve the occurrence of abnormal image, such as image density fluctuations due to the supply shortage.

In the developing device 4-21, a plurality of magnetic poles fixedly disposed in the developing roller is disposed with the five poles of P1 to P5. However, the number of the magnetic poles does not need to be five, i.e., there can be three or four poles.

Figure 11:
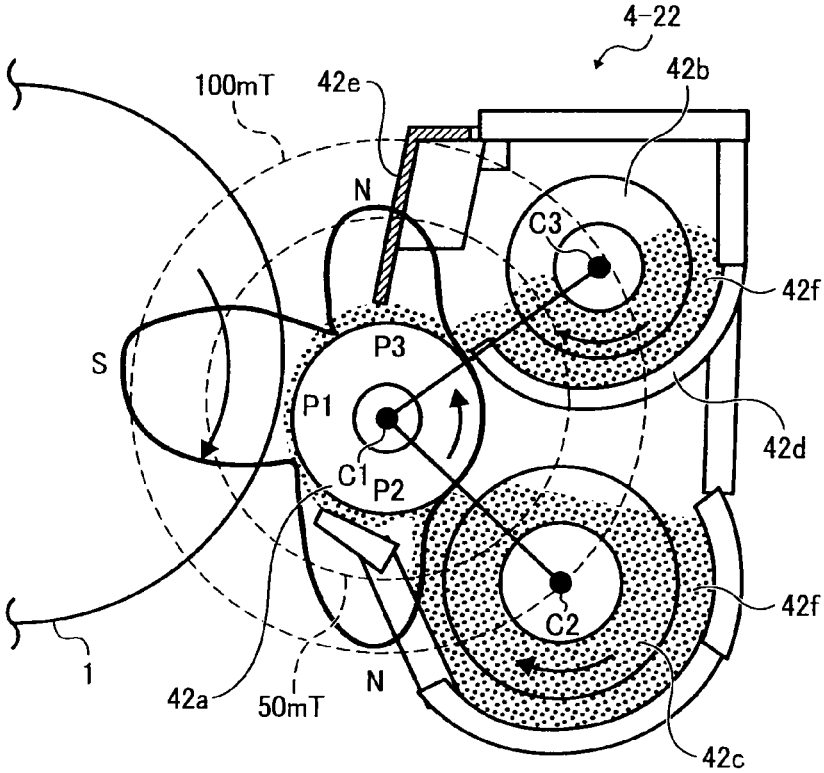
FIG. 11 is a schematic diagram of still another structural example of the developing device shown in FIG. 1.

FIG. 11 depicts a developing device 4-22 as a variant of the developing device 4-21. The developing device 4-22 has basically the same structure as the developing device 4-21 shown in FIG. 8. The difference is that the developing device 4-22 has three magnetic poles of P1, P2, and P3 disposed in the developing roller 42*a*.

Each of the three magnetic poles operates as follows. The developer is pumped and conveyed from the first agitating/conveying screw 42*b* by a P3 pole. A P1 pole is a developing main magnetic pole, and the two-component developer used for developing by the P1 pole is conveyed by a P2 pole. The developer conveyed by the P2 pole reaches a developer separating area produced by the repulsive magnetic field on the sleeve, and is returned to the second agitating/conveying screw 42*c*.

In other words, the P3 pole is the conveying magnetic pole as well as the pumping magnetic pole. Similarly, the P2 pole is the developer separating magnetic pole as well as the conveying magnetic pole.

In the developing device 4-22, the developing main magnetic pole P1, the developer pumping magnetic pole P3 that is also used as the conveying magnetic pole, and the developer separating magnetic pole P2 that is also used as the conveying magnetic pole are disposed in the developing roller 42*a*. The pumping magnetic pole P3 and the developer separating magnetic pole P2 have the same polarity, thereby generating the repulsive magnetic field between the pumping magnetic pole and the developer separating magnetic pole. Accordingly, the developer is separated therefrom. No other magnetic field is present between the pumping magnetic pole P3 and the developer separating magnetic pole P2. In other words, the pumping magnetic pole P3 and the developer separating magnetic pole P2 are adjacent to each other.

Therefore, in between the point at the downstream side in the rotating direction of the developing roller 42*a*, between the two points that the magnetic flux density in the normal direction of the magnetic field formed in the developer separating magnetic pole P2 become substantially zero, and the point at the upstream side in the rotating direction of the developing roller 42*a*, between the two points that the magnetic flux density in the normal direction of the magnetic field formed in the pumping magnetic pole P3 become substantially zero, there is no magnetic force that adsorbs the developer 42*f* on the sleeve, or there is only a weak magnetic field that cannot hold and rotate the developer 42*f* along therewith. As described above, the "magnetic flux density in the normal direction becomes substantially zero" means that the magnetic flux density in the normal direction can only generate a weak magnetic field that cannot hold and rotate the developer along therewith as the above.

In the developing device 4-22, similar to the developing device 4-21, all the developers that have passed through the developing area are returned to the side of the second agitating/conveying screw 42*c* after passing through the developer separating magnetic pole P2. Accordingly, the developer at the side of the first agitating/conveying screw 42*b* is in a refresh (initialized) state not being used for developing, and delivered to the first agitating/conveying screw 42*b* after being mixed and agitated with the fed toner by the second agitating/conveying screw 42*c*. Accordingly, the toner density is not lowered. Therefore, the toner density at the side of the first agitating/conveying screw 42*b* is always constant from the upstream side to the downstream side. Because the toner density on the sleeve of the developing roller 42*a* does not vary, it is possible to obtain a uniform image with good density follow-up and without density difference. The developer conveyed to the developing area is a developer agitated sufficiently, pumped up from the side of the first agitating/conveying screw 42*b*, and passed through the area facing the doctor 42*e* only once. Accordingly, the charging conditions are equal, and the charging amount varies a little. Because the toner is uniformly charged, it is possible to form a good quality image free from toner scattering, ground stain, and detailed image fluctuations.

Figure 10:
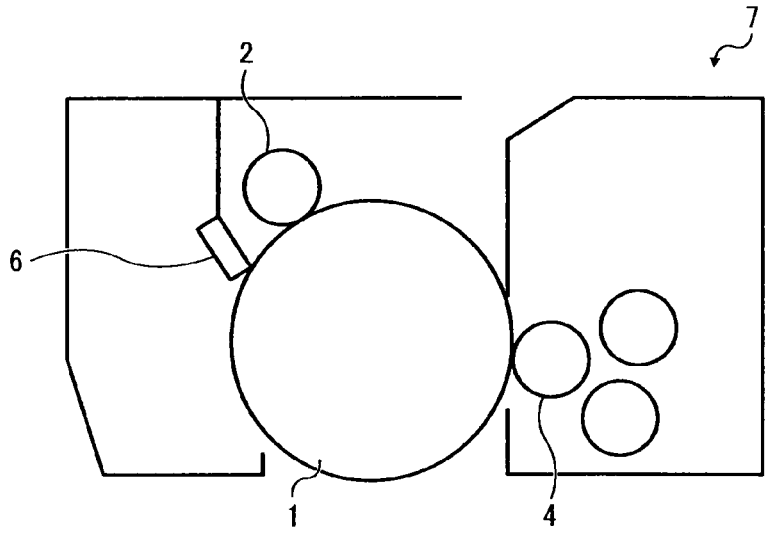
FIG. 10 is a schematic diagram of a process cartridge that includes a developing device according to the present invention.

FIG. 10 is a schematic diagram of an image creating unit 7 of an image forming apparatus that includes the developing device 4 (4-1, 4-2, 4-11, 4-12, 4-13, 4-21, 4-22).

In the image creating unit 7, the photosensitive drum 1 is rotated and driven at a predetermined circumferential speed. The photosensitive drum 1 is uniformly charged with positive or negative predetermined potential at the periphery by a charging device 2, which is a charging unit, in the rotation process. The photosensitive drum 1 then receives image exposure light from an exposing unit (latent image forming unit), which is not shown, such as a slit exposure and a laser beam scanning exposure. Accordingly, electrostatic latent images are sequentially formed at the periphery of the photosensitive drum 1, and the formed electrostatic latent images are developed by the developing device 4, which is a developing unit, using toner. The developed toner images are sequentially transferred by a transferring unit, on a recording medium fed between the photosensitive drum 1 and the transferring unit, which is not shown, supplied from a paper supplying unit, which is not shown, in synchronization with the rotation of the photosensitive body. The recording medium on which the image is transferred is guided to a fixing unit, which is not shown, and fixed thereat, after being separated from the surface of the photosensitive body. The recording medium is then discharged outside the device, as a printed sheet or a duplicate (copy). The surface of the photosensitive drum 1 after the image is transferred is cleaned by removing a transfer residual toner by a cleaning unit (cleaning device that includes a cleaning blade, and a cleaning brush) 6. After being neutralized by a neutralizing unit, which is not shown, the image creating unit 7 is repeatedly used to form an image.

In the image forming apparatus with such a structure and operation, in the present embodiment, a process cartridge that the developing device 4, the photosensitive drum 1, the charging device 2, and the cleaning device 6 are integrally accommodated in a cartridge is used as the image creating unit 7. The process cartridge 7 is detachable with respect to the image forming apparatus main body.

In this manner, the process cartridge 7 according to the present embodiment is formed as an integral structure detachable with respect to the image forming apparatus main body, that integrally accommodates the developing device 4 (4-1, 4-2, 4-11, 4-12, 4-13, 4-21, 4-22) having the structure in the first embodiment or the second embodiment, the photosensitive drum 1, the charging device 2, and the cleaning device 6 in a cartridge. Accordingly, it is possible to improve maintainability and replaceability even in a long-term use.

In the image forming apparatus according to the embodiment shown in FIG. 1, the developing device 4 (4-1, 4-2, 4-11, 4-12, 4-13, 4-21, 4-22) in the first embodiment or the second embodiment is included in the image creating devices 7C, 7Y, 7M, and 7K of each color as a developing unit. Accordingly, it is possible to effectively agitate and convey the developer, and smoothly collect and supply the developer. Subsequently, it is possible to suppress the density fluctuations of the two-component developer on the developing roller 41*a*, and perform stable development for a long period of time. As a result, it is possible to realize an image forming apparatus that can obtain high quality monochrome, multi-color, and full-color images.

In the image forming apparatus according to the embodiment shown in FIG. 1, by including the process cartridge 7 shown in FIG. 10 as the image creating devices 7C, 7Y, 7M, and 7K of each color, it is possible to realize an image forming apparatus that can provide stable high quality images for a long period of time, having a preferable operability, and that can replace the process cartridge 7 easily.

In a developing device according to an aspect of the present invention, the developer is smoothly separated from the developer carrier, and the developer can be smoothly collected from the developer carrier, regardless of the level of the developer in the collecting unit. Accordingly, it is possible to prevent overflow and co-rotation of the developer from occurring. Even in a downsized developing device that has the developing system in which the functions of collecting and supplying are separated, and the toner is mixed and agitated by the second developer agitating/conveying member having the collecting function, there is hardly any magnetic binding force that prevents the developer from being conveyed, with respect to the developer on the second developer agitating/conveying member. Subsequently, it is possible to mix, agitate, convey, and circulate the developer smoothly.

In a developing device according to another aspect of the present invention, there is hardly any magnetic binding force at the position of the line joining the center of the developer carrier and the center of the first developer agitating/conveying member. Accordingly, the collected residual developer having low toner density is not directly pumped into the developer carrier, and it is possible to pump the developer agitated and conveyed by the first developer agitating/conveying member into the developer carrier. Even in downsized developing device that has the developing system in which the functions of collecting and supplying are separated, and the developer is supplied by the first developer agitating/conveying member having the supplying function, it is possible to prevent excessive supply at the upstream side in the conveying direction, and a supply shortage at the downstream side in the conveying direction, of the first developer agitating/conveying member. Subsequently, it is possible to supply a suitable amount of developer to the developer carrier. These are possible because between the two points that the magnetic flux density in the normal direction of the magnetic field formed in the developer pumping magnetic pole in the developer carrier become substantially zero, the point at the upstream side in the rotating direction of the developer carrier is formed at the downstream side with respect to the rotating direction of the developer carrier, than the line joining the center of the developer carrier and the center of the first developer agitating/conveying member.

In a developing device according to still another aspect of the present invention, there is hardly any magnetic binding force at the position of the line joining the center of the developer carrier that has passed through the developer separating magnetic pole and the center of the second developer agitating/conveying member. Accordingly, the developer is smoothly separated from the developer carrier, and the developer can be smoothly collected from the developer carrier, regardless of the level of the developer in the collecting unit. Subsequently, it is possible to prevent overflow and co-rotation of the developer from occurring. There is also hardly any magnetic binding force at the position of the line joining the center of the developer carrier and the center of the first developer agitating/conveying member. Accordingly, the residual developer whose toner density is lowered is not directly pumped into the developer carrier, but the developer collected, and mixed and agitated with the toner by the second developer agitating/conveying member, and delivered to the first developer agitating/conveying member, and agitated and conveyed thereby, can be pumped into the developer carrier.

Even in a downsized developing device that has the developing system in which the functions of collecting and supplying are separated, the toner is mixed and agitated by the second developer agitating/conveying member having the collecting function, and the developer is supplied by the first developer agitating/conveying member having the supplying function, it is possible to mix, agitate, convey, and circulate the developer smoothly. This is because there is hardly any magnetic binding force that prevents the developer from being conveyed, with respect to the developer on the first developer agitating/conveying member, and the second developer agitating/conveying member. Therefore, it is possible to solve the problems such as image density fluctuations due to insufficient mixing and agitation, and supply shortage of the developer.

In a developing device according to still another aspect of the present invention, in addition to the above advantages, it is possible to effectively prevent excessive supply of developer at the upstream side in the conveying direction of the first developer agitating/conveying member.

In a developing device according to still another aspect of the present invention, even a small amount of developer can be effectively supplied to the developer carrier, and it is possible to effectively prevent supply shortage at the downstream side in the conveying direction. Accordingly, it is possible to effectively solve the problems such as image density fluctuations due to supply shortage. It is also possible to reduce the rotation speed of the first developer agitating/conveying member used for supplying.

In a developing device according to still another aspect of the present invention, it is possible to collect, agitate, convey, circulate, and supply the developer smoothly.

In a developing device according to still another aspect of the present invention, there is hardly any magnetic binding force at the position of the line joining the center of the developer carrier that has passed through the developer separating magnetic pole and the center of the developer agitating/conveying member. Accordingly, the developer is smoothly separated from the developer carrier, and the developer can be smoothly collected from the developer carrier, regardless of the level of the developer in the collecting unit. Subsequently, it is possible to prevent overflow and co-rotation of the developer from occurring.

In a developing device according to still another aspect of the present invention, there is hardly any magnetic binding force at the position of the line joining the center of the developer carrier and the center of the developer agitating/conveying member. Accordingly, the residual developer whose toner density is lowered is not directly pumped into the developer carrier, but the developer mixed, agitated, and conveyed by the developer agitating/conveying member can be pumped into the developer carrier.

In a developing device according to still another aspect of the present invention, the residual developer whose toner density is lowered is not directly pumped into the developer carrier, but the developer mixed, agitated, and conveyed by the developer agitating/conveying member can be pumped into the developer carrier. Therefore, even if the developer is collected and supplied by the same developer agitating/conveying member, it is possible to collect, mix, agitate, convey, and supply the developer effectively. Accordingly, it is possible to solve the problems such as image density fluctuations, due to insufficient mixing and agitating of the developer.

A process cartridge according to still another aspect of the present invention includes the above developing device, and is detachably formed with respect to the image forming apparatus main body. Accordingly, it is possible to realize a process cartridge that can provide stable high quality images for a long period of time, having a preferable operability, and that can be replaced easily.

An image forming apparatus according to still another aspect of the present invention includes the above developing device. Accordingly, it is possible to realize an image forming apparatus that can perform stable development for a long period of time and that can provide high-quality images.

In an image forming apparatus according to still another aspect of the present invention, in addition to the above advantages, by forming a monochrome, a multi-color, or a full-color image by including a plurality of image creating units, it is possible to realize an image forming apparatus that can provide high-quality monochrome, multi-color, or full-color images for a long period of time.

In an image forming apparatus according to still another aspect of the present invention, in addition to the above advantages, by including the above process cartridge, it is possible to realize an image forming apparatus that can provide stable high-quality images for a long period of time, having a preferable operability, and that can replace the process cartridge easily.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a cylindrical developer carrier to rotate on a developer carrier shaft including a plurality of magnetic poles arranged therein, to carry a developer including magnetic particles and toner, and to supply the developer to an electrostatic latent image formed on an image carrier to develop the electrostatic latent image, wherein the plurality of magnetic poles include magnetic poles disposed adjacent to each other and having a same polarity, a first magnetic pole of the magnetic poles disposed adjacent to each other being located downstream with respect to a rotation direction of the cylindrical developer carrier, a second magnetic pole of the magnetic poles disposed adjacent to each other being located upstream with respect to the rotation direction of the cylindrical developer carrier;

a first developer agitating/conveying member to rotate on a first shaft parallel to the developer carrier shaft, to agitate and convey developer along the first shaft, and to supply the developer to the cylindrical developer carrier;

a second developer agitating/conveying member to rotate on a second shaft parallel to the developer carrier shaft, to agitate and convey the developer in a reverse direction from a direction the first developer agitating/conveying member conveys the developer, wherein the second developer agitating/conveying member conveys the developer to the first developer agitating/conveying member while agitating the developer, wherein the cylindrical developer carrier includes, a first point where magnetic flux density generated by the second magnetic pole in a normal direction becomes maximum, a second point upstream from the first point with respect to a rotating direction of the cylindrical developer carrier, where the magnetic flux density in the normal direction becomes substantially zero, and a third point downstream from the first point with respect to the rotating direction of the cylindrical developer carrier, where the magnetic flux density in the normal direction becomes substantially zero, wherein the third point is formed upstream from a line joining a center of the cylindrical developer carrier and a center of the second developer agitating/conveying member with respect to the rotating direction of the cylindrical developer carrier;

a fourth point where magnetic flux density generated by the first magnetic pole in the normal direction becomes maximum;

a fifth point upstream from the fourth point with respect to rotating direction of the cylindrical developer carrier, where the magnetic flux density in the normal direction becomes substantially zero;

a sixth point downstream from the fourth point with respect to the rotating direction of the cylindrical developer carrier, where the magnetic flux density in the normal direction becomes substantially zero, wherein the fifth point is formed downstream from a line joining the center of the cylindrical developer carrier and a center of the first developer agitating/conveying member with respect to the rotating direction of the cylindrical developer carrier, the first developer agitating/conveying member and the second developer agitating/conveying member are disposed in a vertical direction, and the cylindrical developer carrier includes only three magnetic poles.

2. The developing device according to claim 1, wherein the plurality of magnetic poles further includes a developing-main magnetic pole, wherein the first magnetic pole functions as a conveying magnetic pole, and wherein the first magnetic pole and the second magnetic pole form a repulsive magnetic field between the first magnetic pole and the second magnetic pole to separate the developer from the cylindrical developer carrier.

3. A process cartridge mounted on an image forming apparatus comprising:

the developing device according to claim 1.

4. An image forming apparatus comprising:

the developing device according to claim 1.

5. The developing device according to claim 1, wherein the first developer agitating/conveying member and the second developer agitating/conveying member are screws.

6. The developing device according to claim 1, wherein the first developer agitating/conveying member supplies the developer to the cylindrical developer carrier and the second developer agitating/conveying member collects the developer from the cylindrical developer carrier.

7. The developing device according to claim 1, wherein the developer is separated from the cylindrical developer carrier on the line joining the center of the cylindrical developer carrier and the second developer agitating/conveying member.

8. The developing device according to claim 1, wherein a seventh point where the line joining the center of the cylindrical developer carrier and the center of the second developer agitating/conveying member intersects with a surface of the cylindrical developer carrier and is located upstream from an eighth point where the line joining the center of the cylindrical developer carrier and the center of the first developer carrier agitating/conveying member intersects with a surface of the cylindrical developer carrier with respect to the rotating direction of the cylindrical developer carrier.

9. A developing device comprising:

a cylindrical developer carrier to rotate on a developer carrier shaft including a plurality of magnetic poles arranged therein, to carry a developer including magnetic particles and toner, and to supply the developer to an electrostatic latent image formed on an image carrier to develop the electrostatic latent image, wherein the plurality of magnetic poles include magnetic poles disposed adjacent to each other and having a same polarity, a first magnetic pole of the magnetic poles disposed adjacent to each other being located downstream with respect to a rotation direction of the cylindrical developer carrier, a second magnetic pole of the magnetic poles disposed adjacent to each other being located upstream with respect to the rotation direction of the cylindrical developer carrier;

a first developer agitating/conveying member to rotate on a first shaft parallel to the developer carrier shaft, to agitate and convey developer along the first shaft, and to supply the developer to the cylindrical developer carrier;

a second developer agitating/conveying member to rotate on a second shaft parallel to the developer carrier shaft, to agitate and convey the developer in a reverse direction from a direction the first developer agitating/conveying member conveys the developer, wherein the second developer agitating/conveying member conveys the developer to the first developer agitating/conveying member while agitating the developer, wherein the cylindrical developer carrier includes, a first point where magnetic flux density generated by the second magnetic pole in a normal direction becomes maximum, a second point upstream from the first point with respect to a rotating direction of the cylindrical developer carrier, where the magnetic flux density in the normal direction becomes substantially zero, and a third point downstream from the first point with respect to the rotating direction of the cylindrical developer carrier, where the magnetic flux density in the normal direction becomes substantially zero, wherein the third point is formed upstream from a line joining a center of the cylindrical developer carrier and a center of the second developer agitating/conveying member with respect to the rotating direction of the cylindrical developer carrier;

a fourth point where magnetic flux density generated by the first magnetic pole in the normal direction becomes maximum;

a fifth point upstream from the fourth point with respect to rotating direction of the cylindrical developer carrier, where the magnetic flux density in the normal direction becomes substantially zero; and a sixth point downstream from the fourth point with respect to the rotating direction of the cylindrical developer carrier, where the magnetic flux density in the normal direction becomes substantially zero, wherein the fifth point is formed downstream from a line joining the center of the cylindrical developer carrier and a center of the first developer agitating/conveying member with respect to the rotating direction of the cylindrical developer carrier, wherein the cylindrical developer carrier includes only three magnetic poles.

10. A developing device comprising:

a cylindrical developer carrier to rotate on a developer carrier shaft including a plurality of magnetic poles arranged therein, to carry a developer including magnetic particles and toner, and to supply the developer to an electrostatic latent image formed on an image carrier to develop the electrostatic latent image, wherein the plurality of magnetic poles include magnetic poles disposed adjacent to each other and having a same polarity, a first magnetic pole of the magnetic poles disposed adjacent to each other being located downstream with respect to a rotation direction of the cylindrical developer carrier, a second magnetic pole of the magnetic poles disposed adjacent to each other being located upstream with respect to the rotation direction of the cylindrical developer carrier;

a first developer agitating/conveying member to rotate on a first shaft parallel to the developer carrier shaft, to agitate and convey developer along the first shaft, and to supply the developer to the cylindrical developer carrier;

a second developer agitating/conveying member to rotate on a second shaft parallel to the developer carrier shaft, to agitate and convey the developer in a reverse direction from a direction the first developer agitating/conveying member conveys the developer, wherein the second developer agitating/conveying member conveys the developer to the first developer agitating/conveying member while agitating the developer, wherein the cylindrical developer carrier includes, a first point where magnetic flux density generated by the second magnetic pole in a normal direction becomes maximum, a second point upstream from the first point with respect to a rotating direction of the cylindrical developer carrier, where the magnetic flux density in the normal direction becomes substantially zero, and a third point downstream from the first point with respect to the rotating direction of the cylindrical developer carrier, where the magnetic flux density in the normal direction becomes substantially zero, wherein the third point is formed upstream from a line joining a center of the cylindrical developer carrier and a center of the second developer agitating/conveying member with respect to the rotating direction of the cylindrical developer carrier;

a fourth point where magnetic flux density generated by the first magnetic pole in the normal direction becomes maximum;

a fifth point upstream from the fourth point with respect to rotating direction of the cylindrical developer carrier, where the magnetic flux density in the normal direction becomes substantially zero;

a sixth point downstream from the fourth point with respect to the rotating direction of the cylindrical developer carrier, where the magnetic flux density in the normal direction becomes substantially zero, wherein the fifth point is formed downstream from a line joining the center of the cylindrical developer carrier and a center of the first developer agitating/conveying member with respect to the rotating direction of the cylindrical developer carrier; and a wall unit to separate the first developer agitating/conveying member and the second developer agitating/conveying member, wherein the second developer agitating/conveying member is located directly below the first developer agitating/conveying member, and an end of the wall unit, from which the developer is supplied to the cylindrical developer carrier, is disposed at least above the line joining the center of the cylindrical developer carrier and the center of the first developer agitating/conveying member.

11. A developing device comprising:

a cylindrical developer carrier to rotate on a developer carrier shaft including a plurality of magnetic poles arranged therein, to carry a developer including magnetic particles and toner, and to supply the developer to an electrostatic latent image formed on an image carrier to develop the electrostatic latent image, wherein the plurality of magnetic poles include magnetic poles disposed adjacent to each other and having a same polarity, a first magnetic pole of the magnetic poles disposed adjacent to each other being located downstream with respect to a rotation direction of the cylindrical developer carrier, a second magnetic pole of the magnetic poles disposed adjacent to each other being located upstream with respect to the rotation direction of the cylindrical developer carrier;

a first developer agitating/conveying member to rotate on a first shaft parallel to the developer carrier shaft, to agitate and convey developer along the first shaft, and to supply the developer to the cylindrical developer carrier;

a second developer agitating/conveying member to rotate on a second shaft parallel to the developer carrier shaft, to agitate and convey the developer in a reverse direction from a direction the first developer agitating/conveying member conveys the developer, wherein the second developer agitating/conveying member conveys the developer to the first developer agitating/conveying member while agitating the developer;

a wall unit to separate the first developer agitating/conveying member and the second developer agitating/conveying member, wherein the second developer agitating/conveying member is located directly below the first developer agitating/conveying member, and an end of the wall unit, from which the developer is supplied to the cylindrical developer carrier, is disposed at least above the line joining the center of the cylindrical developer carrier and the center of the first developer agitating/conveying member, wherein the cylindrical developer carrier includes, a first point where magnetic flux density generated by the second magnetic pole in a normal direction becomes maximum, a second point upstream from the first point with respect to a rotating direction of the cylindrical developer carrier, where the magnetic flux density in the normal direction becomes substantially zero, and a third point downstream from the first point with respect to the rotating direction of the cylindrical developer carrier, where the magnetic flux density in the normal direction becomes substantially zero, wherein the third point is formed upstream from a line joining a center of the cylindrical developer carrier and a center of the second developer agitating/conveying member with respect to the rotating direction of the cylindrical developer carrier;

a fourth point where magnetic flux density generated by the first magnetic pole in the normal direction becomes maximum;

a fifth point upstream from the fourth point with respect to rotating direction of the cylindrical developer carrier, where the magnetic flux density in the normal direction becomes substantially zero;

a sixth point downstream from the fourth point with respect to the rotating direction of the cylindrical developer carrier, where the magnetic flux density in the normal direction becomes substantially zero, wherein the fifth point is formed downstream from a line joining the center of the cylindrical developer carrier and a center of the first developer agitating/conveying member with respect to the rotating direction of the cylindrical developer carrier, the first developer agitating/conveying member and the second developer agitating/conveying member are disposed in a vertical direction.

12. The developing device according to claim 11 herein a height of the end of the wall unit, from which the developer is supplied to the cylindrical developer carrier, is lower at a downstream side than an upstream side with respect to conveying a direction of the developer in the first developer agitating/conveying member.

13. The developing device according to claim 11, wherein the plurality of magnetic poles further includes a developing-main magnetic pole, wherein the first magnetic pole functions as a conveying magnetic pole, and wherein the first magnetic pole and the second magnetic pole form a repulsive magnetic field between the first magnetic pole and the second magnetic pole to separate the developer from the cylindrical developer carrier.

14. A process cartridge mounted on an image forming apparatus comprising:

the developing device according to claim 11.

15. An image forming apparatus comprising:

the developing device according to claim 11.

16. The developing device according to claim 11, wherein the first developer agitating/conveying member and the second developer agitating/conveying member are screws.

17. The developing device according to claim 11, wherein the first developer agitating/conveying member supplies the developer to the cylindrical developer carrier and the second developer agitating/conveying member collects the developer from the cylindrical developer carrier.

18. The developing device according to claim 11, wherein the developer is separated from the cylindrical developer carrier on the line joining the center of the cylindrical developer carrier and the second developer agitating/conveying member.

19. The developing device according to claim 11, wherein a seventh point where the line joining the center of the cylindrical developer carrier and the center of the second developer agitating/conveying member intersects with a surface of the cylindrical developer carrier and is located upstream from an eighth point where the line joining the center of the cylindrical developer carrier and the center of the first developer carrier agitating/conveying member intersects with a surface of the cylindrical developer carrier with respect to the rotating direction of the cylindrical developer carrier.

* * * * *